US006409420B1

(12) United States Patent
Horton et al.

(10) Patent No.: US 6,409,420 B1
(45) Date of Patent: Jun. 25, 2002

(54) PORTABLE VEHICLE BARRIER

(75) Inventors: Craig Howard Horton; Gary R. Cook, both of Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/895,102

(22) Filed: Jul. 2, 2001

(51) Int. Cl.[7] ..... E01F 13/12
(52) U.S. Cl. ..... 404/6
(58) Field of Search ..... 404/6

(56) References Cited

U.S. PATENT DOCUMENTS 2,918,740 A * 12/1959 Smith ..... 49/49
5,328,292 A * 7/1994 Williams ..... 404/6
5,820,293 A * 10/1998 Groen et al. ..... 256/1
6,155,745 A * 12/2000 Groen et al. ..... 404/6
6,206,608 B1 * 3/2001 Blevins ..... 404/6

FOREIGN PATENT DOCUMENTS

FR 2 714 404 * 6/1995

* cited by examiner

*Primary Examiner*—Gary S. Hartmann
(74) *Attorney, Agent, or Firm*—David Kalmbaugh

(57) ABSTRACT

A portable vehicle barrier which is configured as a net to disable and prevent further movement of vehicle traveling across the vehicle barrier. The net has a lead array of spikes and a trailing array of spikes which puncture and adhere to the front and rear tires of the vehicle, preventing rotational movement of the vehicle's tires. Each spike of the lead and trailing array has a doom shaped cover which is jettisoned from its associated spike after the front tires of the vehicle pass over the lead array of the net.

20 Claims, 10 Drawing Sheets

PORTABLE VEHICLE BARRIER

BACKGROUND OF THE INVENTION

1. Field of the Invention

The present invention relates generally to an apparatus which prevents a vehicle from gaining access to or exiting from a particular location. More specifically, the present invention relates to a vehicle barrier which is portable, light weight and is easily moved from one location to another location without the use of heavy equipment to move the barrier.

2. Description of the Prior Art.

Currently, there are in use a variety of barrier systems which will either prevent a vehicle from leaving a location such as a parking lot or from accessing a location such as a restricted government facility or a military installation. For example, parking lots have spikes which allow a vehicle to exit the lot but do not allow the vehicle to reenter the lot without deflating and causing sever damage to the vehicle's tires. However, this type of vehicle barrier is not portable.

Concrete barriers are another means for preventing an automobile, truck or other moving vehicle from entering or leaving a location. While concrete barriers are an effective means for preventing access to a particular location such as a Government building the barriers are very heavy requiring cranes and trucks to move the barriers from one location to another location. In addition, a significant amount of time is required to move concrete barriers from one location to another location.

Unfortunately, barriers used in the past often rely on their own weight, size and mass to prevent stop and/or movement of vehicle, such as an automobile or truck, to or from a particular location. These vehicle barriers do not address the need to deploy vehicle barriers quickly without the use of heavy construction equipment, especially in an emergency go situation.

Vehicle barriers that have been developed for rapid deployment without the use of heavy construction equipment rely on deflating the tires of a moving vehicle trying to enter or leave a site which may be, for example, a restricted area such as a military installation. These vehicle barriers generally deflate the vehicle's tires in an attempt to stop the vehicle's tires. The deflating of a moving vehicle's tire does not necessarily mean that the vehicle will become disabled and the driver may loose control of the vehicle causing property damage and injury to the driver as well injury to individuals in the path of the vehicle. Further, a vehicle can run on puncture resistant tires, i.e. tires filled with foam or other material.

Accordingly, there is a need for a light weight, portable and rapidly deployable vehicle barrier which effectively stop a moving vehicle without causing property damage and serious injury to the driver or other individuals in the vicinity of the vehicle.

SUMMARY OF THE INVENTION

The present invention overcomes some of the disadvantages of the past including those mentioned above in that it comprises a relatively simple in design yet highly effective portable vehicle barrier which when deployed will disable and stop a moving vehicle. This, in turn, will prevent property damage and serious injury to the driver of the vehicle and any individual in the vicinity of the vehicle.

Portable vehicle barrier comprises a generally rectangular shaped barrier device in the form of net. The net system of the portable vehicle barrier disables a moving vehicle and stops its movement in the vehicle's direction of travel. The rectangular shaped net system includes a plurality of elongated cables which are evenly spaced apart and a plurality of cross cables which are evenly spaced apart and are perpendicular to the elongated cables of the net system.

Each cross cable of the net system intersects the elongated cables of the net system at a plurality of intersection points. The net system has a trailing array comprising the last three cross cables of the net system and a lead array comprising the first three cross cables of the net system.

Coupled to each intersection point of the trailing array of the net system on the under side of the net system is a spike and its associated dome shaped cover. Coupled to each intersection point of the lead array of the net system on the upper side of the net system is a spike and its associated dome shaped cover.

The trailing array of the net system is folded over the net system at a fold such that each of the dome shaped covers of the net system are in contact with the tires of a vehicle as the vehicle passes over vehicle barrier.

The front wheel of a vehicle approaching the portable vehicle barrier first passes over the lead array of the net system. After the front wheels of the vehicle passes over the lead array, the dome shaped covers for the spikes of the lead array are jettisoned. This exposes the spikes of the lead array to the rear tires of the vehicle.

The dome shaped covers for each of the spikes of the trailing array are also jettisoned which results in the spikes of the trailing array being exposed to front tires of the vehicle. This results in the front tires of the vehicle being punctured by and adhering to the spikes of the trailing array and the rear tires being punctured by and adhering to the spikes of the lead array. The net system is now configured to prevent rotational movement of the front and rear tires of the vehicle, preventing further movement of the vehicle in the direction of vehicle travel. When vehicle movement ceases, the lead array of the net system is wrapped around the front tires and the trailing array of the net system is wrapped around the rear tires.

DETAILED DESCRIPTION OF THE PREFERRED EMBODIMENTS

Figure 1:
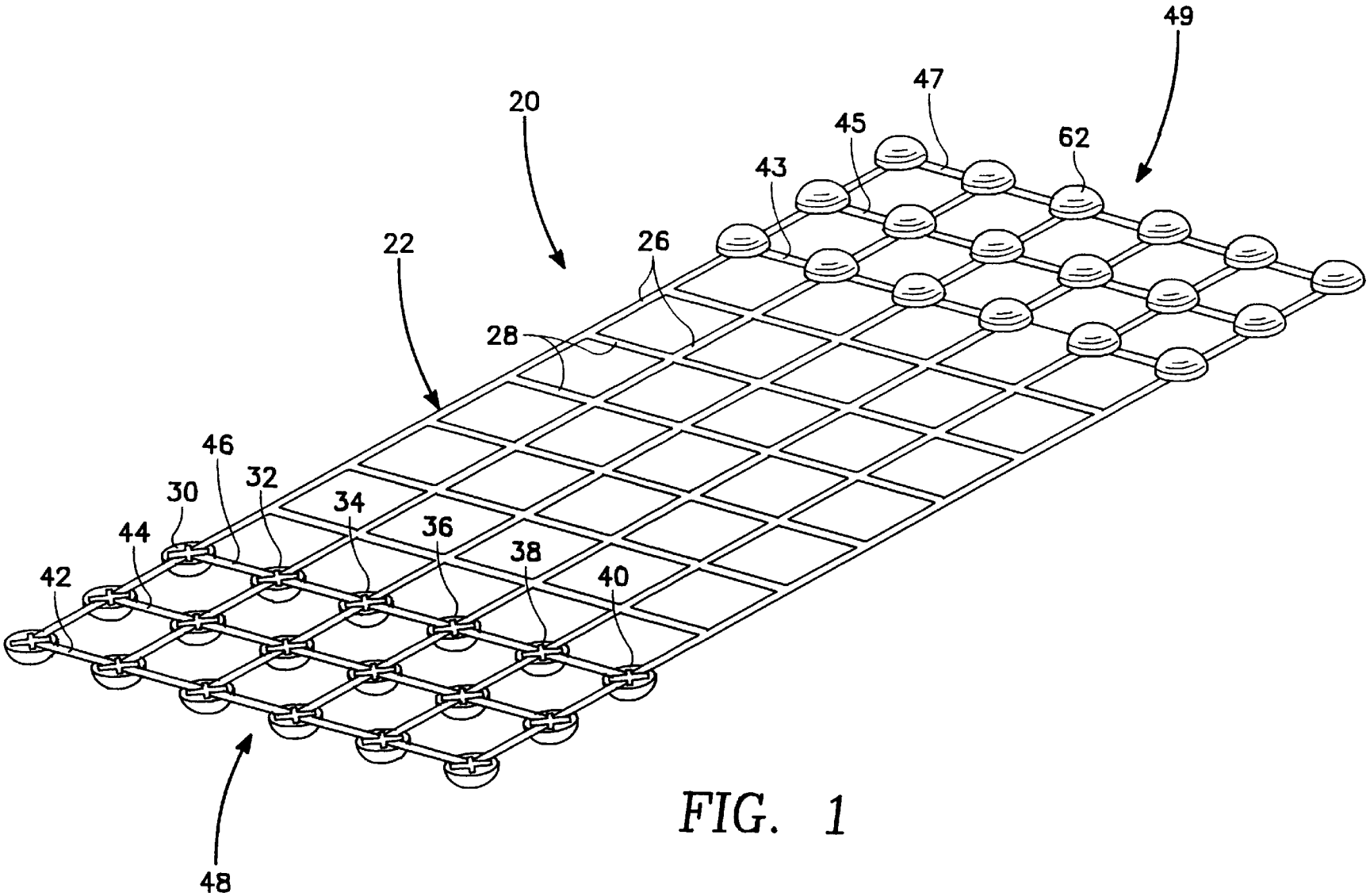
FIG. 1 is a perspective view of a first embodiment of a portable vehicle barrier which will disable and stop a moving vehicle.
Figure 2:
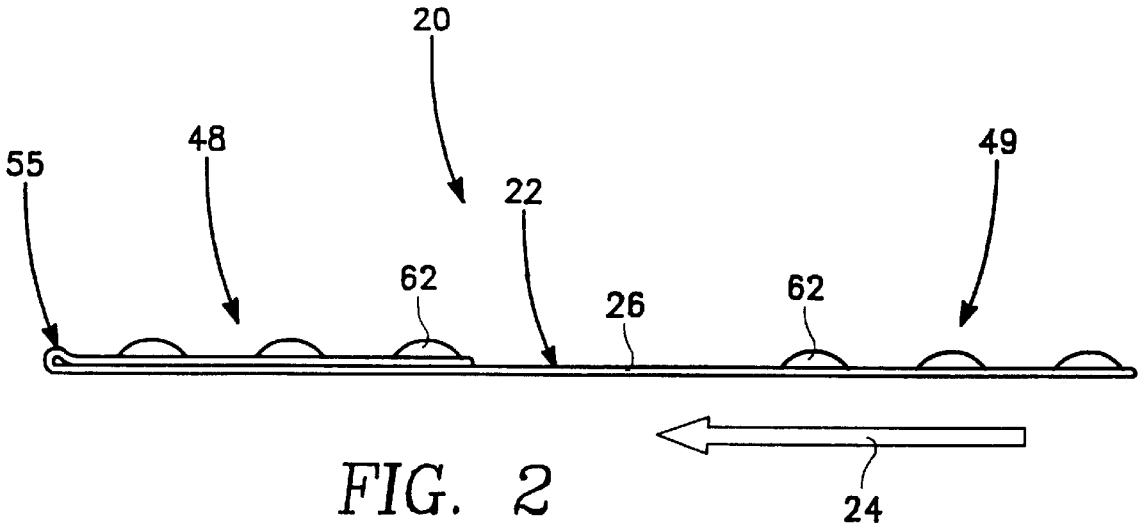
FIG. 2 is a partial view of the embodiment of the portable vehicle barrier illustrated in FIG. 1.

Referring to FIGS. 1 and 2, there is shown a portable vehicle barrier, designated generally by the reference numeral 20, which when deployed will disable and stop a moving vehicle. Portable vehicle barrier 20 comprises a generally rectangular shaped barrier device in the form of net which may be fabricated from kevlar or other suitable materials which are light weight and easily movable from a first site to a second site. The net system 22 of portable vehicle barrier disables a moving vehicle, such as a car or truck, and stops its movement in the vehicle's direction of travel which is indicated by arrow 24 (FIG. 2). The rectangular shaped net system 22 includes a plurality of elongated cables 26 which are evenly spaced apart and run the direction of travel 24 of a moving vehicle. The rectangular shaped net system 22 also has a plurality of cross cables 28 which are evenly spaced apart and are perpendicular to the elongated cables 26 of net system 22 as shown in FIG. 1.

Referring to FIGS. 1, 2, 3, 4, 5 and 6, as shown in FIG. 1, net system 22 comprises six elongated cables 26 and twelve cross cables 28. Each of six elongated cables 26 and twelve cross cables 28 of net system 22 are fabricated from a light weight, flexible material such as aramid fibers, commonly thrown by the trademark Kevlar which resists breaking when a vehicle travels across portable vehicle barrier 20. It should be understood that the net system 22 of vehicle barrier 20 can include any number of elongated cables 26 and cross cables 28 depending upon on the size and shape of the net system required for a particular application.

Figure 3:
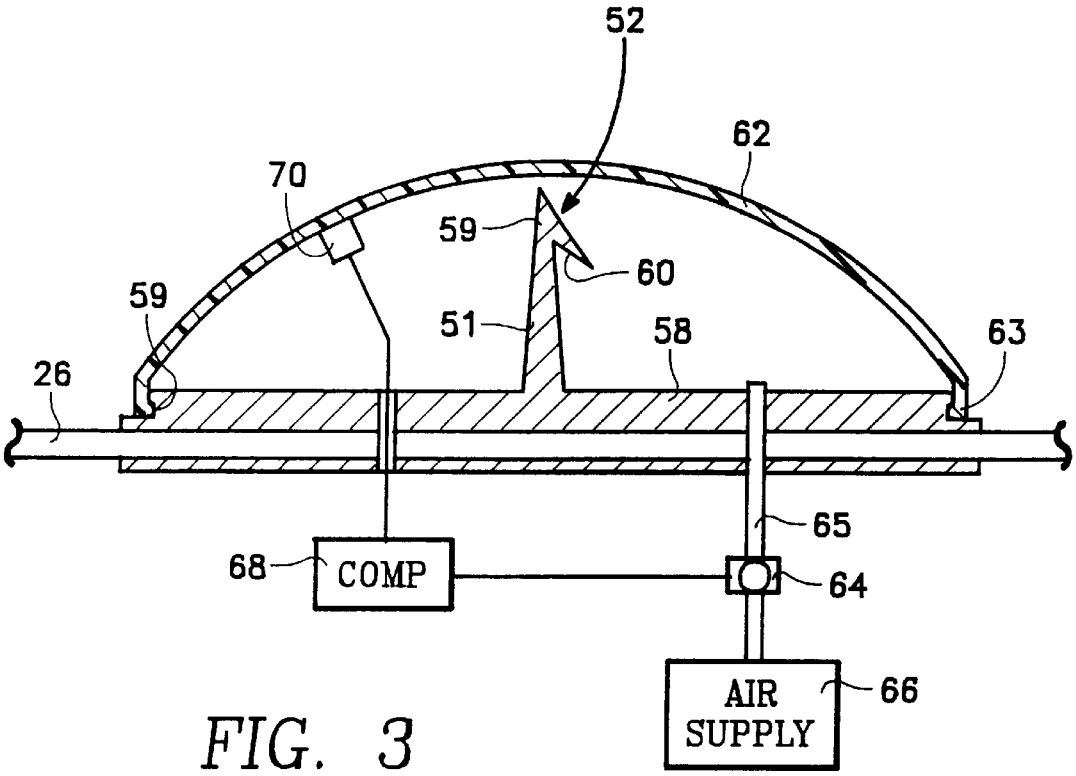
FIG. 3 is a side view of one of the spikes and its associated dome shaped bubble housing of the embodiment of the portable vehicle barrier of FIG. 1.

Each cross cable 28 of net system 22 intersects the six elongated cables 26 of net system 22 respectively at intersection points 30, 32, 34, 36, 38 and 40. Coupled to each intersection point 30, 32, 34, 36, 38 and 40 of rows 42, 44 and 46 of net system 22 on the under side of net system 22 is a spike 52 and its associated dome shaped cover 62 (FIG. 3). The trailing array 48 of net system 22 comprises rows 42, 44 and 46 of net system 22.

Similarly, there is coupled to each intersection point 30, 32, 34, 36, 38 and 40 of rows 43, 45 and 47 of net system 22 on the upper side of net system 22 a spike 52 and its associated dome shaped cover 62. The lead array 49 of net system 22 comprises rows 43, 45 and 47 of net system 22.

As shown in FIG. 2, the trailing array 48 consisting of rows 42, 44 and 46 of net system 22 is folded over net system 22 at fold 55 such that each of the dome shaped covers 62 of net system 22 are in contact with the tires 54 and 56 of a vehicle as the vehicle passes over vehicle barrier 20.

Referring to FIG. 3, each spike 52 of net system 22 has a shank 51 and a sharp pointed edge 59 which is designed to puncture the tires 54 and 56 of a vehicle as the vehicle travels across portable vehicle barrier 20. Each spike 52 is mounted on a base 58 with each base 58 being affixed to net system 22 at one of the intersection points 30, 32, 34, 36, 38 and 40 of rows 42, 43, 44, 45 and 46 of net system 22. The upper end of each spike 52 of net system 22 includes a hook 60 which causes the spike 52 to adhere to tire 54 or 56 when the tire 54 or 56 is punctured by spike 52. The dome shaped cover 62 for each spike 52 includes a flange 63. Flange 63 of cover 62 fits into a recess 59 within base 58 in the manner illustrated in FIG. 2 and may be fabricated from any conventional and well known high strength polymer and polyurethane material.

Each dome shaped cover 62 of vehicle barrier 20 may be jettisoned from its base 58 by a variety of jettison devices including the device illustrated in FIG. 3. Jettisoning the dome shaped covers 62 for each spike 52 exposes the spikes 52 of barrier 20 to the tires 54 an 56 of the vehicle.

The jettison device illustrated in FIG. 3 includes a source of compressed air 66 which supplies compressed air through an air line or fluid passageway 65 to the interior of dome shaped cover 62 when a normally closed valve 64 is activated. Connected to normally closed valve 64 is a digital computer 68 which activates valve 64. When computer 68 activates normally closed valve 64 compressed air flows from source 66 through air line 65 into dome shaped cover 62 jettisoning dome shaped cover 62 which exposes spike 52.

A sensor 70 is mounted on dome shaped cover 62. Sensor 78 detects the presence of a tire 54 or 56 passing over dome shaped cover 62 and provides an electrical signal to computer 68 which indicates that a vehicle tire is passing over cover 68. Computer 68 processes the electrical signal from sensor 70 and activates normally closed valve 64 after the tire 54 and 56 after the tire 54 or 56 clears dome shaped cover 62 which jettisons cover 62 exposing spike 52 to the vehicle's tires. The time delay for jettisoning dome shaped cover 62 after the vehicle tire clears dome shaped cover 62 is variable (e.g. 0.1 second to 5 second) and will be set by the user of barrier 20.

Spikes 52 could also be spring loaded with the spring for each spike 52 being tripped by computer 68. Tripping the spring for spike 52 results in the spike moving upward jettisoning the dome shaped cover 62 which exposes the vehicle's tires to spike 52.

Figure 4:
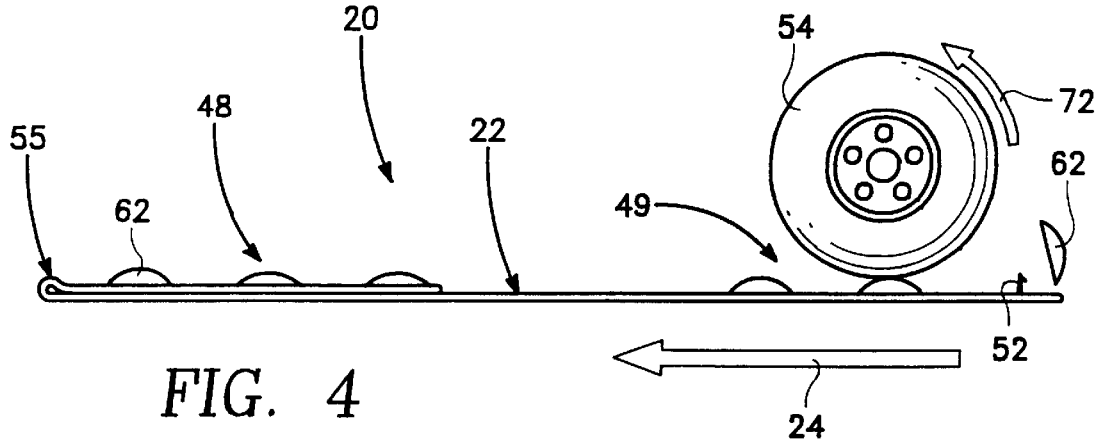
FIGS. 4–6 illustrate the front and rear tires of a vehicle traveling across and engaging the embodiment of the portable vehicle barrier of FIG. 1.

Referring to FIGS. 1–6, as shown in FIG. 4, the front wheel 54 (rotating counterclockwise as indicted by arrow 72) of the vehicle first passes over the forward end of vehicle barrier 20 which includes the spikes 52 and covers 62 for the lead array 49 of net system 22. After the front wheel 54 of the vehicle passes over each of the rows of lead array 49, the dome shaped covers for each of the rows 43, 45 and 47 of lead array 49 are jettisoned. FIG. 4 depicts the dome shaped covers 62 for row 47 of lead array 49 being jettisoned after tire 54 passes over row 47 of lead array 49 exposing the spikes 52 of row 47 to tire 56.

Figure 5:
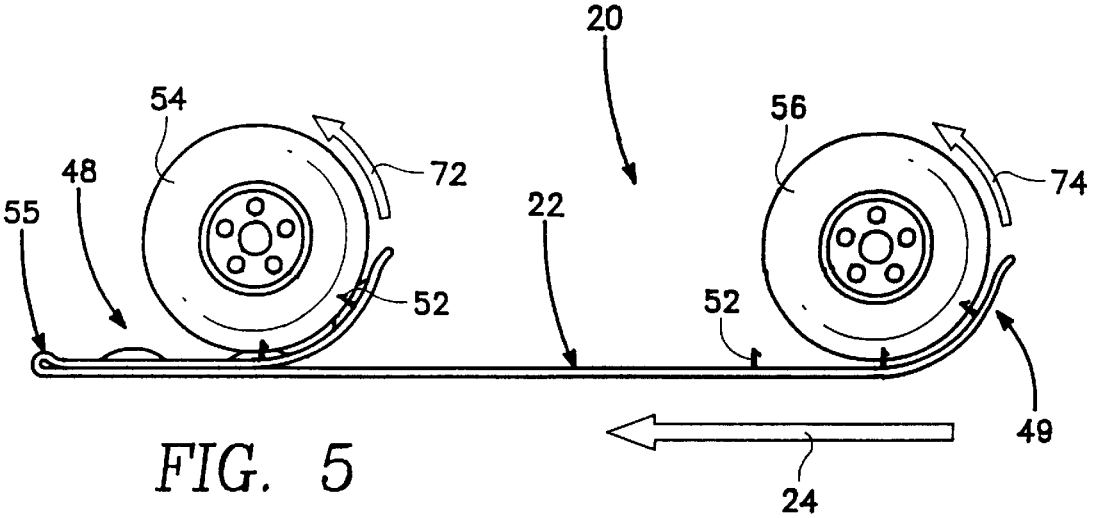
Figure 6:
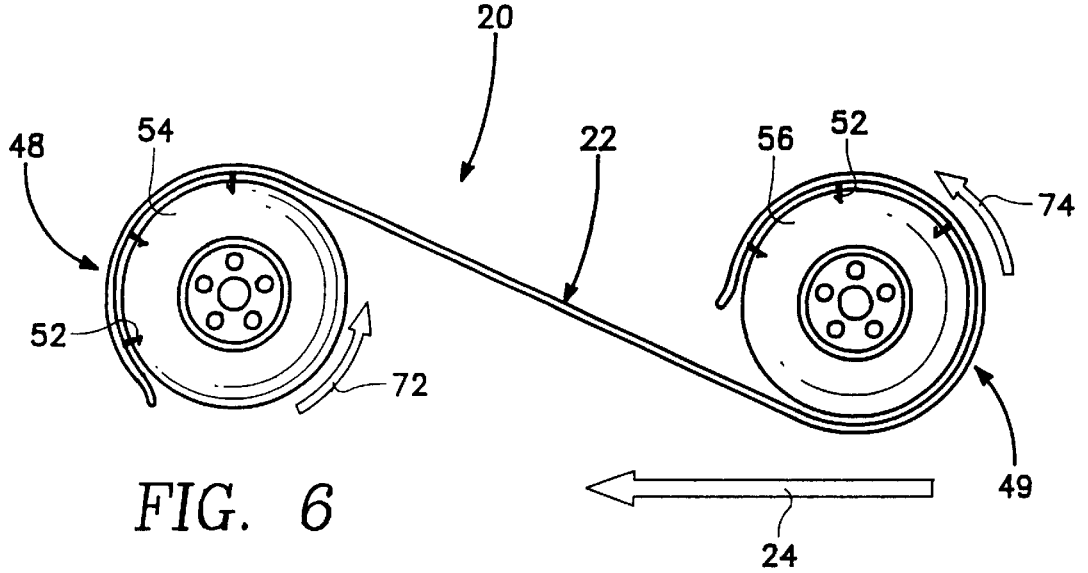

FIG. 5 depicts the dome shaped covers 62 for each row 43, 45 and 47 of lead array 49 and each row 42, 44 and 46 of trailing array 48 as being jettisoned. This results in front tire 54 being punctured by and adhering to the spikes 52 of trailing array 48. In a like manner, rear tire 56 (rotating in the counterclockwise direction as indicated by arrow 74) is punctured by and adheres to the spikes 52 of lead array 49. As shown in FIG. 6, the net system 22 when configured in the manner illustrated in FIG. 1 prevent rotation of tires 54 and 56 in the counterclockwise direction (as indicated by arrows 72 and 74), preventing further movement of the vehicle in direction of travel (as indicted by arrow 24). When vehicle movement ceases, lead array 49 of net system 22 is wrapped around front tire 54 and trailing array 48 of net system 22 is wrapped around rear tire 56 in the manner illustrated in FIG. 6.

Figure 7:
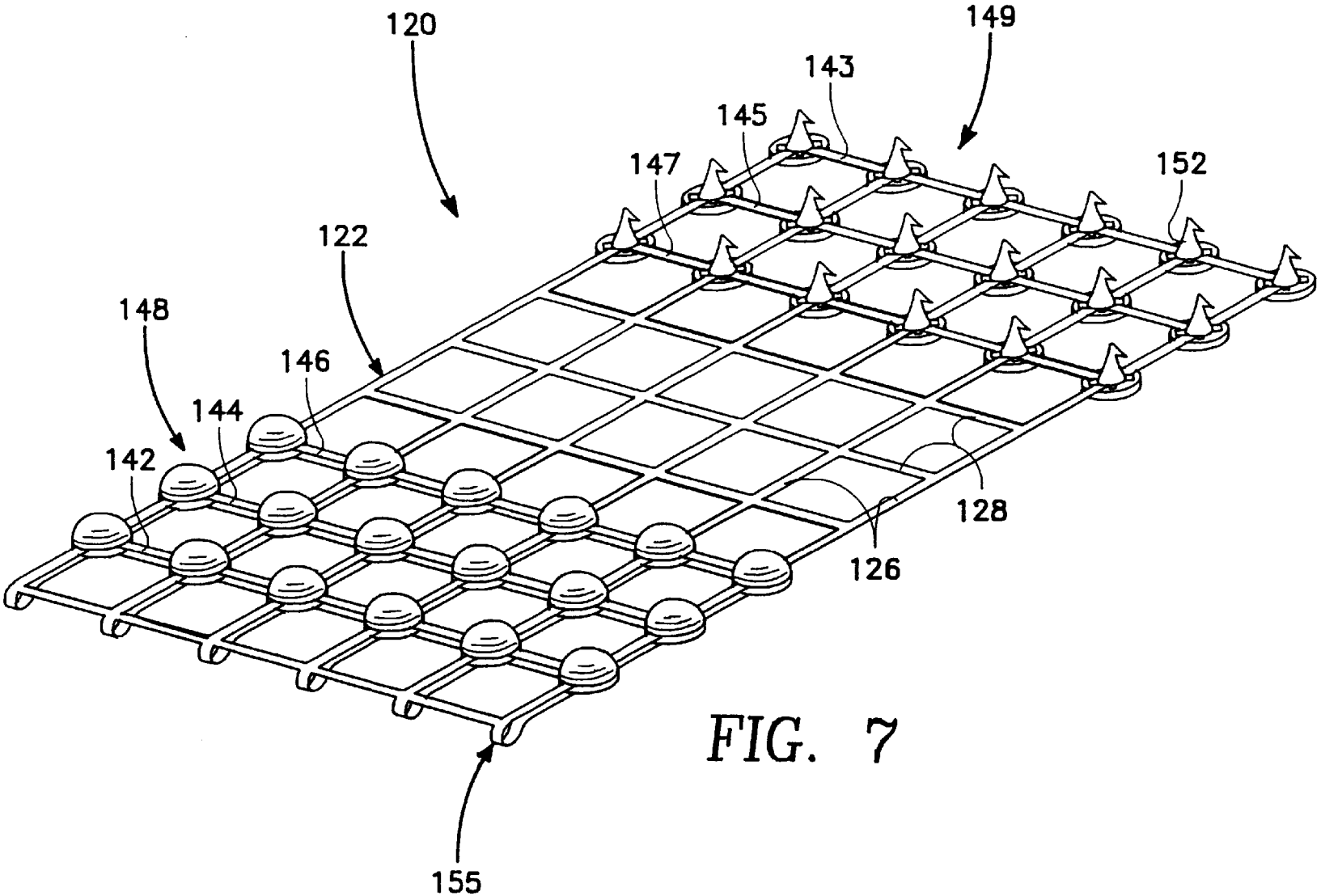
FIG. 7 is a perspective view of a second embodiment of a portable vehicle barrier which will disable and stop a moving vehicle.
Figure 8:
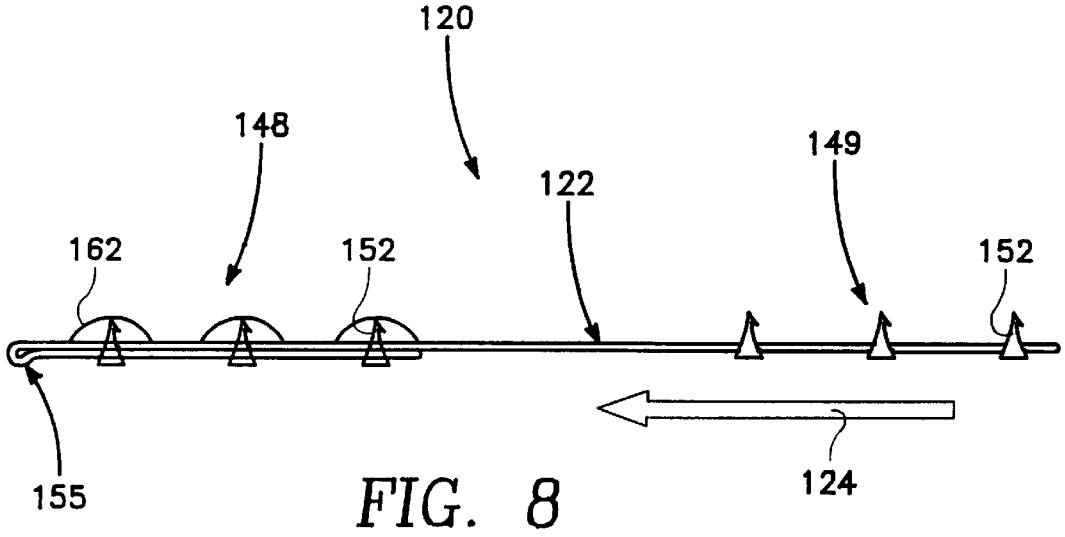
FIGS. 8–11 illustrate the front and rear tires of a vehicle traveling across and engaging the embodiment of the portable vehicle barrier of FIG. 7.

Referring to FIG. 7, there is shown a second embodiment of a portable vehicle barrier, designated generally by the reference numeral 120, which will disable and completely stop a vehicle traveling in the direction of travel indicated by arrow 124. The lead array 149 of net system 122 comprises rows 143, 145 and 147 of net system 122. The spikes 152 of lead array 149 are exposed, that is the spikes of lead array 149 do not include a cover. As shown in FIG. 7, the trailing array 48 consists of rows 142, 144 and 146 of net system 122. There is a fold 155 at the trailing edge of array 149 with the rear portion 153 of array 149 being folded under net system 122 in the manner illustrated in FIG. 8. The spikes 152 for rows 142, 144 and 146 of array 148 are mounted on the rear portion 153 of array 148. Each spike 152 of array 148 includes a dome shaped cover 62 which is fixedly attached to trailing array 148 so as not to be jettisoned from portable vehicle barrier 120 after the tires 154 and 156 of a vehicle pass over vehicle barrier 120.

Figure 9:
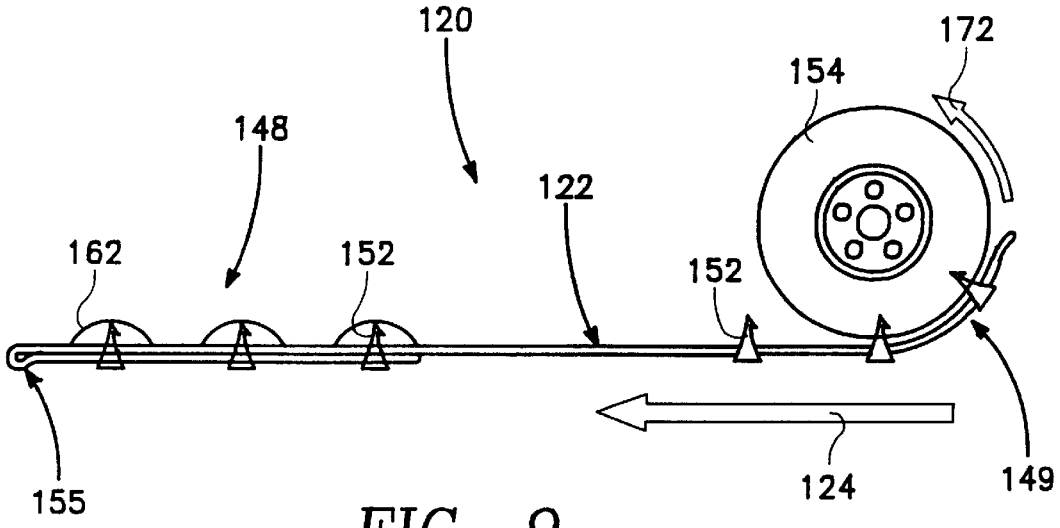
Figure 10:
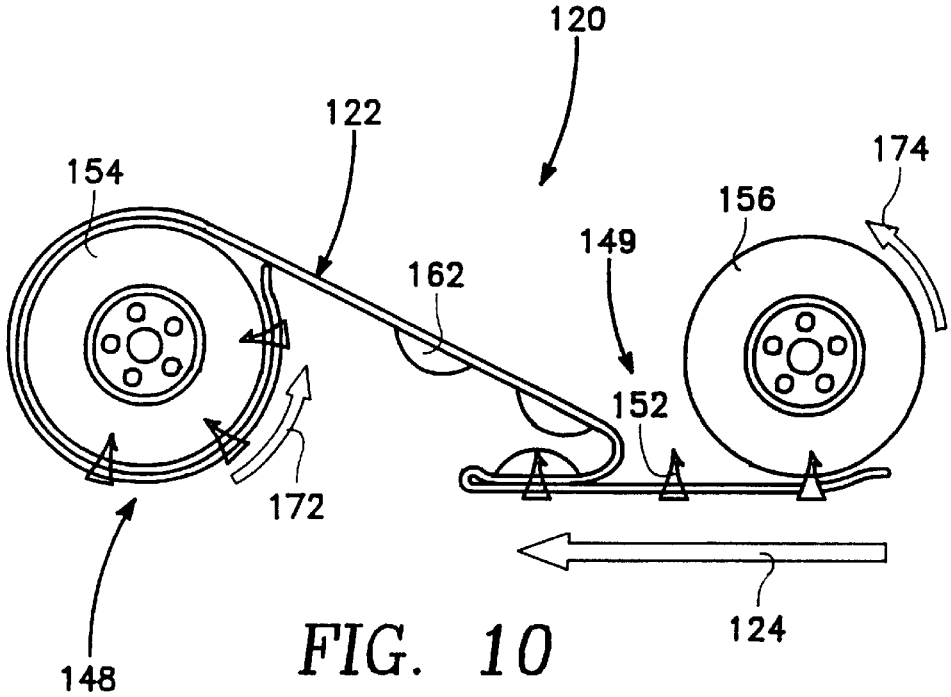

Referring to FIGS. 7–11, as shown in FIG. 9 the front wheel 154 (rotating counterclockwise as indicted by arrow 172) of the vehicle first passes over the forward end of vehicle barrier 120 which includes the spikes 152 for the lead array 149 of net system 22. This results in front tire 154 being punctured by and adhering to the spikes 52 of lead array 149. As the vehicle continues to move in the direction indicated by arrow 124, the forward end of net system 122 becomes wrapped around front tire 154 in the manner illustrated in FIG. 10. This removes the dome shaped cover 162 for rows 142, 144 and 146 of trailing array 148 exposing the spikes 152 of trailing array 148 to the rear tire 156 of the vehicle. Rear tire 156 (rotating in the counterclockwise direction as indicated by arrow 174) is punctured by and adheres to the spikes 152 of lead array 149 as depicted in FIG. 9.

Figure 11:
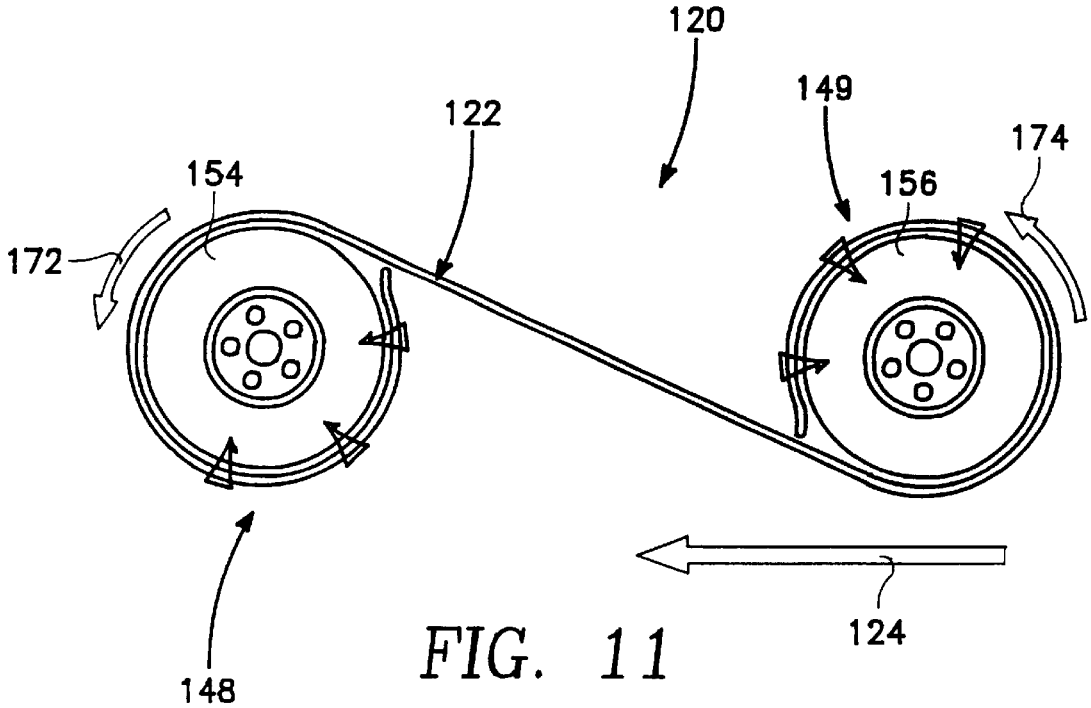

As shown in FIG. 11, the net system 122 when configured in the manner illustrated in FIG. 7 prevents rotation of tires 154 and 156 in the counterclockwise direction (as indicated by arrows 172 and 174), preventing further movement of the vehicle in direction of travel (as indicted by arrow 124). When vehicle movement ceases, lead array 149 of net system 122 is wrapped around front tire 154 and trailing array 148 of net system 122 is wrapped around rear tire 156 in the manner illustrated in FIG. 10.

Figure 12:
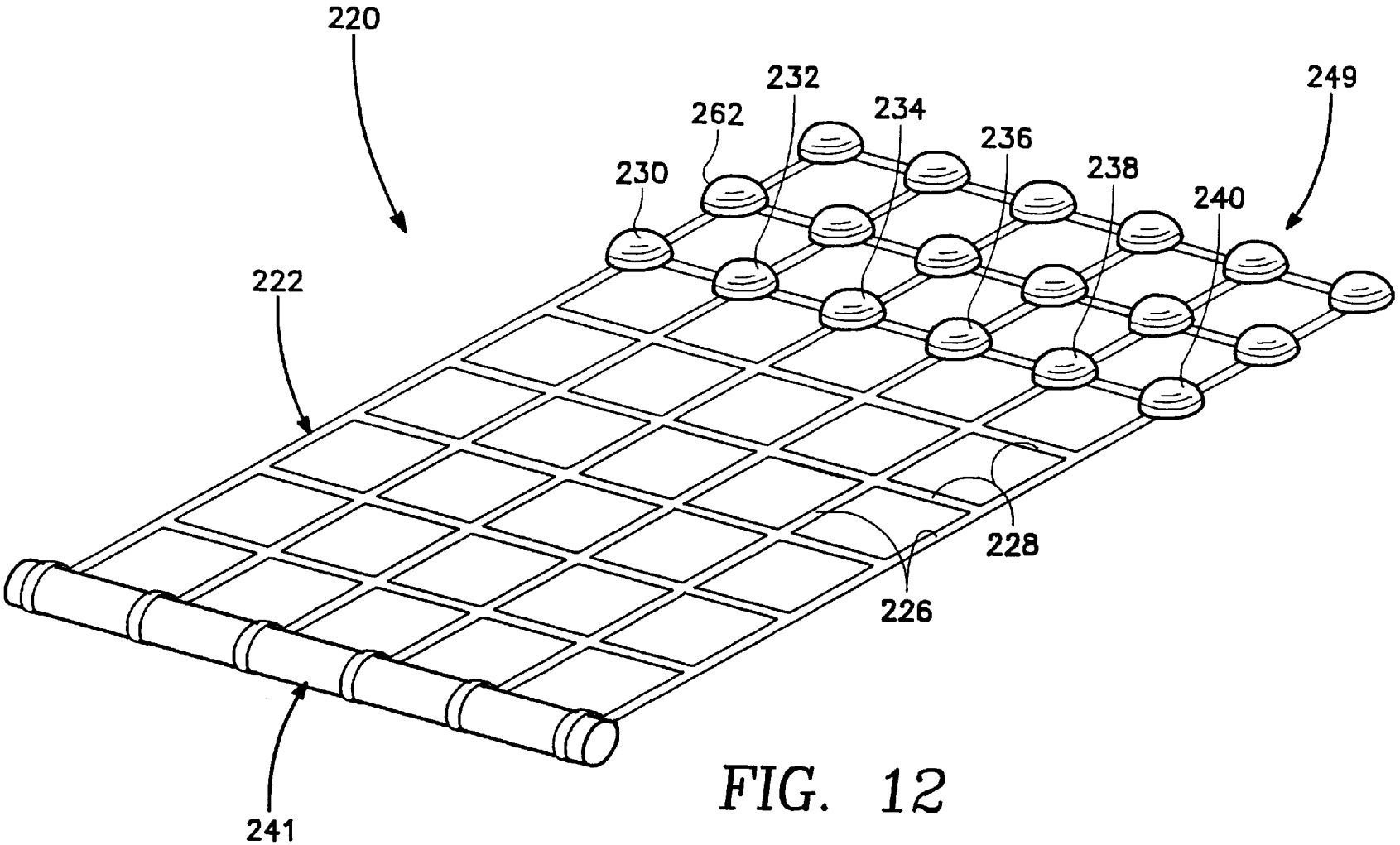
FIG. 12 is a perspective view of a third embodiment of a portable vehicle barrier which will disable and stop a moving vehicle.
Figure 13:
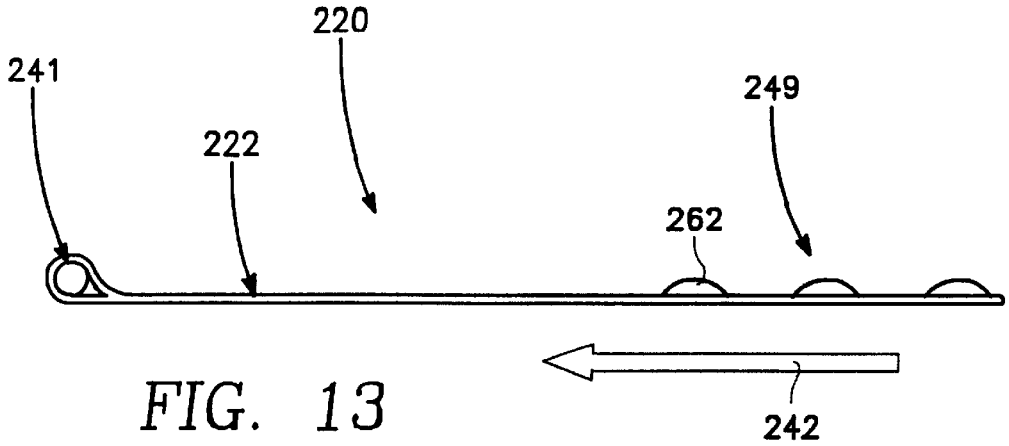
FIGS. 13–19 illustrate the front and rear tires of a vehicle traveling across and engaging the embodiment of the portable vehicle barrier of FIG. 12.
Figure 14:
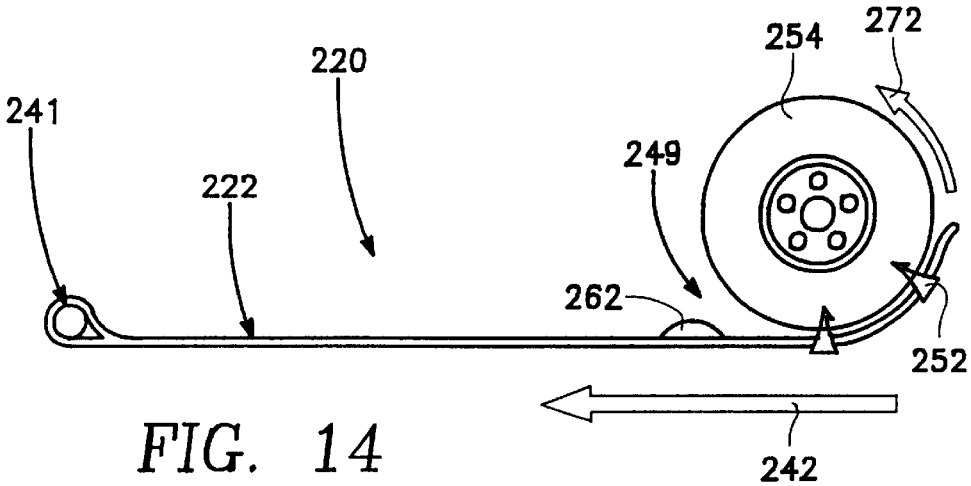
Figure 15:
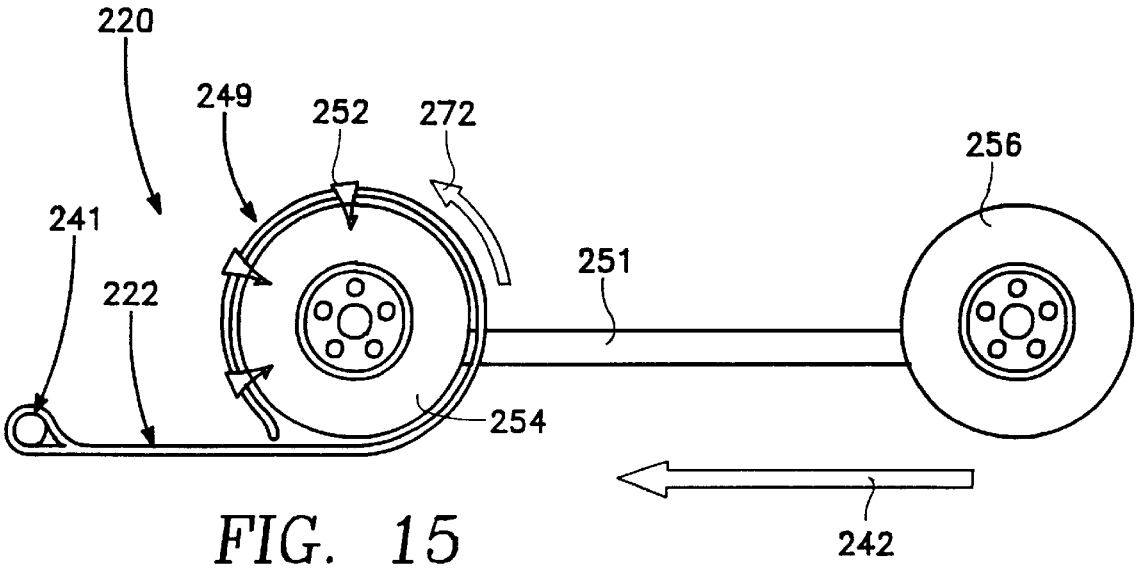
Figure 16:
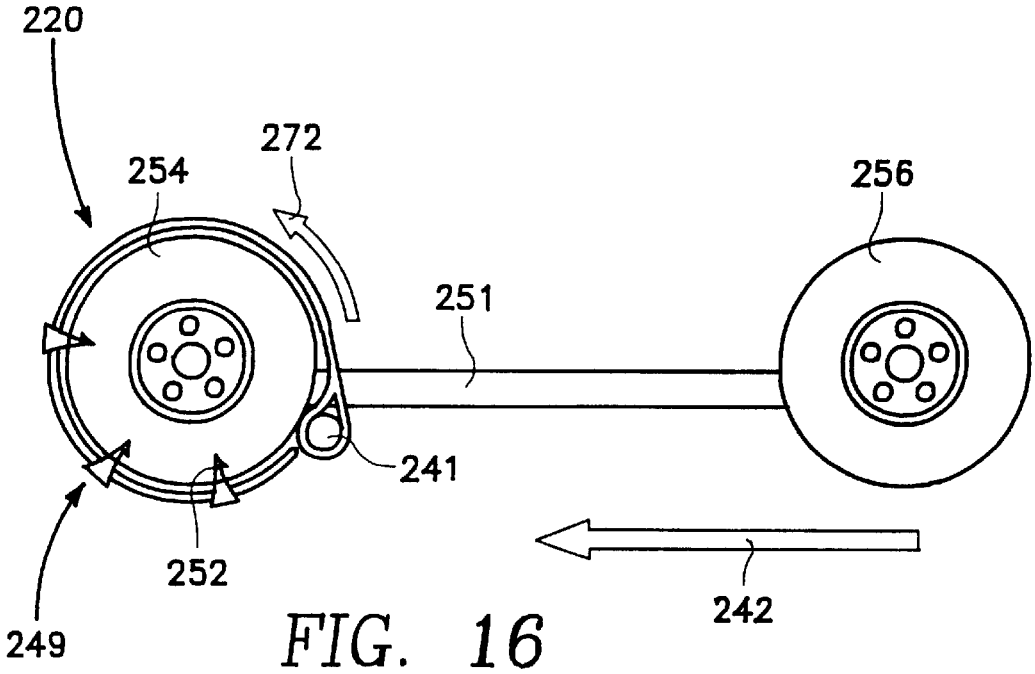
Figure 17:
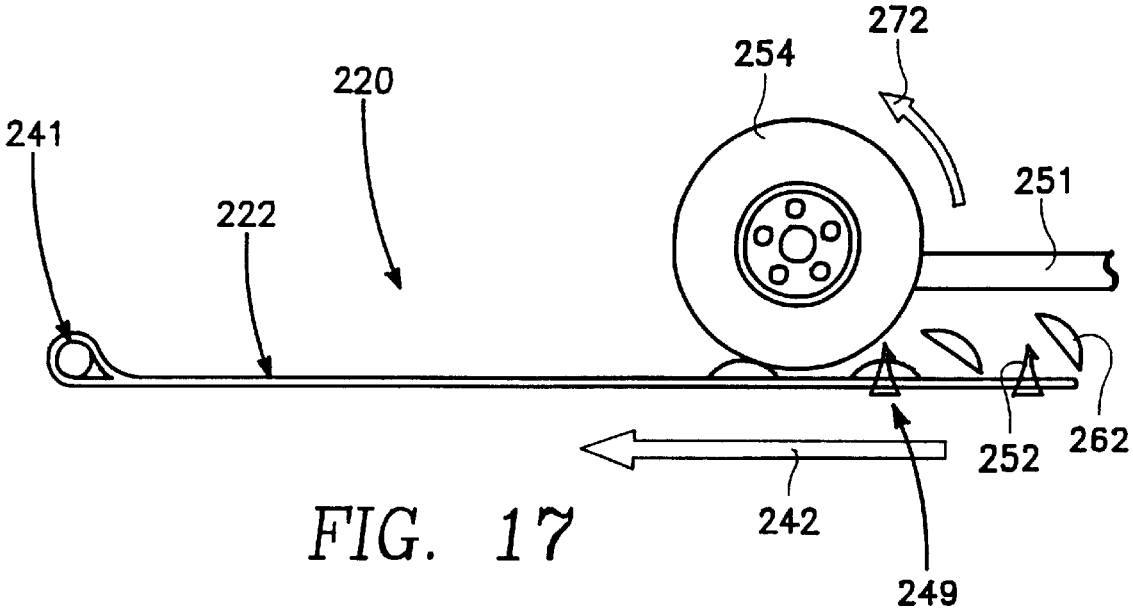
Figure 18:
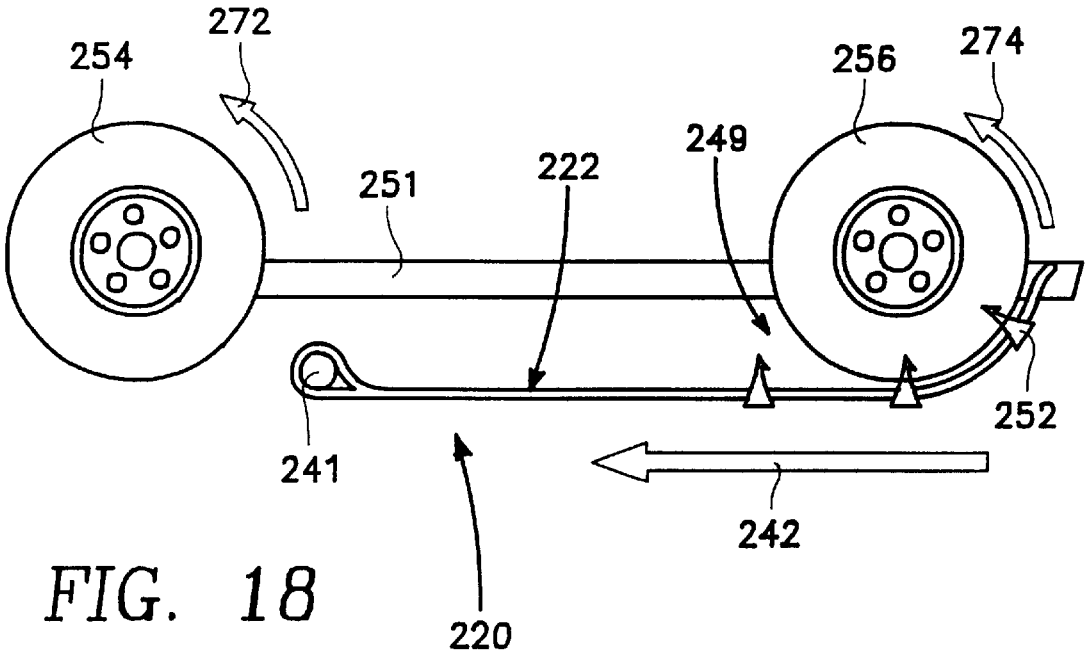
Figure 19:
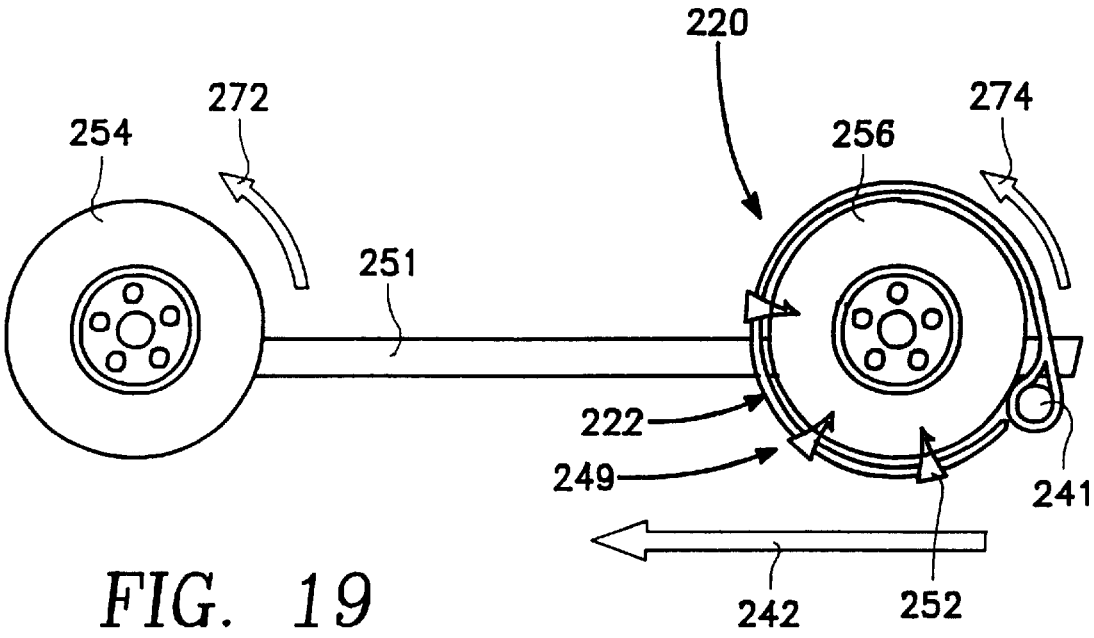

Referring to FIG. 12, there is shown a third embodiment of a portable vehicle barrier, designated generally by the reference numeral 220, which will disable and completely stop a vehicle traveling in the direction of travel indicated by arrow 224. The lead array 249 of net system 222 comprises rows 243, 245 and 247 of net system 222. The lead array 249 of net system 222 includes a plurality of spikes 252 and their associated dome shaped cover 262. The lead array 249 of net system 22 has a spikes 252 and its associated covers 262 coupled to each intersection point 230, 232, 234, 236, 238 and 240 of rows 242, 244 and 246 of net system 222.

The rear of net system 222 includes a cylindrical shaped member 241 which runs the width of net system 222. Cylindrical shaped member 241 may be, for example, a pipe.

Referring to FIGS. 13–16, the covers 262 of lead array 249 are jettisoned prior to a vehicle traveling in the direction of arrow 242 exposing the spikes 252 of lead array 249 to the front tires 254 of the vehicle. The spikes 252 of lead array 249 puncture and adhere to front tires 254 (rotating in the counterclockwise direction 272) which results in net system 222 being wrapped around front tires 254. The cylindrical shaped member 241, which is now completely wrapped around the front tires 254, engages the vehicle frame 251 in the manner illustrated in FIG. 16 stopping the vehicle.

Referring to FIGS. 12 and 17–19, the covers 262 of lead array 249 are jettisoned after the front tires 254 of a vehicle traveling in the direction of arrow 242 pass over the covers of lead array 249. This exposes the spikes 252 of lead array 249 to the rear tires 256 of the vehicle. The spikes 252 of lead array 249 puncture and adhere to rear tires 256 (rotating in the counterclockwise direction 274) which results in net system 222 being wrapped around rear tires 256. The cylindrical shaped member 241, which is now completely wrapped around the rear tires 256, engages the vehicle frame 251 in the manner illustrated in FIG. 19 stopping the vehicle.

From the foregoing, it may readily be seen that the present invention comprises a new, unique and exceedingly portable vehicle barrier for disabling a vehicle traveling the portable vehicle barrier which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A portable vehicle barrier for disabling a vehicle having front and rear tires traveling across said portable vehicle barrier comprising:

(a) a generally rectangular shaped barrier device comprising a net, said net including a plurality of elongated cables which are evenly spaced apart and a plurality of cross cables which are evenly spaced apart and are perpendicular to the elongated cables of said net;

(b) a lead array of said cross cables including first, second, and third rows of said cross cables located at a front end of said net;

(c) a trailing array of said cross cables including N−2, N−1, and N rows of said cross cables located at a rear end of said net, wherein N is an integer greater than or equal to three;

(d) each of the cross cables of the lead array of said cross cables and the trailing array of said cross cables intersecting the elongated cables of said net at a plurality of intersection points;

(e) a first array of spikes, one of said first array of spikes being connected to each of the plurality of intersection points of the lead array of said cross cables on an upper side of said net;

(f) a first array of dome shaped covers, one of said first array of dome shaped covers resting on top of an associated one of said first array of spikes and being removable from said associated one of said first array of spikes;

(h) a second array of spikes, one of said second array of spikes being connected to each of the plurality of intersection points of the trailing array of said cross cables on a lower side of said net, said trailing array of spikes being folded over a middle portion of said net to expose said second array of spikes to the front tires of said vehicle;

(i) a second array of dome shaped covers, one of said second array of dome shaped covers resting on top of an associated one of said second array of spikes and being removable from said associated one of said second array of spikes;

(j) removal means for jettisoning said first array of dome shaped covers and said second array of dome shaped covers from said net after the front tires of said vehicle pass over the lead array of said cross cables exposing the front tires of said vehicle to said second array of spikes and the rear tires of said vehicle to said first array of spikes; and (l) said second array of spikes being capable of puncturing and adhering to the front tires of said vehicle and said first array of spikes being capable of puncturing and adhering to the rear tires of said vehicle, thereby resulting in the rear end of said net being wrapped around the front tires of said vehicle and the front end of said net being wrapped around the rear tires of said vehicle disabling said vehicle when said vehicle travels across said portable vehicle barrier.

2. The portable vehicle barrier of claim 1 wherein said plurality of elongated cables of said net consist of six elongated cables and said plurality of cross cables of said net consist of twelve cross cables.

3. The portable vehicle barrier of claim 2 wherein the six elongated cables and the twelve cross cables of said net are each fabricated from aramid fibers.

4. The portable vehicle barrier of claim 1 wherein said removal means comprises:

(a) compression means for providing compressed air;

(b) a plurality of fluid passageways, one end of each of said fluid passageways being connected to said compression means and the opposite end of each of said fluid passageways being connected to an interior of each of said dome shaped covers within said first and second array of dome shaped covers;

(iii) a plurality of valve means, one of said plurality of valve means being positioned within each of said fluid passageways to prevent fluid flow through said fluid passageways;

(d) sensing means mounted on each of said dome shaped covers within said first array of dome shaped covers, said sensing means detecting the presence of the front tires of said vehicle passing over said first array of dome shaped covers and providing electrical signals which indicate that the front tires of said vehicle are passing over said first array of dome shaped covers;

(e) signal processing means connected to said sensing means to receive and process said electrical signals from said sensing means;

(f) said signal processing means, responsive to said electrical signals, activating said plurality of valve means after the front tires of said vehicle clears said first array of doomed shaped covers; and (g) said plurality of valve means when activated allowing said compressed air to flow from compression means into the interior of each of said dome shaped covers within said first and second array of dome shaped covers causing each of said dome shaped covers within said first and second array of dome shaped covers to be jettisoned from said net.

5. The portable vehicle barrier of claim 4 wherein each of said plurality of valve means comprises a normally closed valve.

6. The portable vehicle barrier of claim 4 wherein said sensing means comprises a plurality of sensors, one of said plurality of sensors being mounted on each of said dome shaped covers within said first array of dome shaped cover, said plurality of sensors being connected to said signal processing means.

7. The portable vehicle barrier of claim 4 wherein said signal processing means comprises a computer.

8. The portable vehicle barrier of claim 4 wherein said signal processing means comprises a digital computer.

9. A portable vehicle barrier for disabling a vehicle having front and rear tires traveling across said portable vehicle barrier comprising:

(a) a generally rectangular shaped barrier device comprising a net, said net including a plurality of elongated cables which are evenly spaced apart and a plurality of cross cables which are evenly spaced apart and are perpendicular to the elongated cables of said net;

(b) a lead array of said cross cables including first, second, and third rows of said cross cables located at a front end of said net;

(c) a trailing array of said cross cables including N−2, N−1, and N rows of said cross cables located at a rear end of said net, wherein N is an integer greater than or equal to three;

(d) each of the cross cables of the lead array of said cross cables and the trailing array of said cross cables intersecting the elongated cables of said net at a plurality of intersection points;

(e) a first array of spikes, one of said first array of spikes being connected to each of the plurality of intersection points of the lead array of said cross cables on an upper side of said net;

(f) a first array of dome shaped covers, one of said first array of dome shaped covers resting on top of an associated one of said first array of spikes and being removable from said associated one of said first array of spikes;

(h) a second array of spikes, one of said second array of spikes being connected to each of the plurality of intersection points of the trailing array of said cross cables on a lower side of said net, said trailing array of spikes being folded over a middle portion of said net to expose said second array of spikes to the front tires of said vehicle;

(i) a second array of dome shaped covers, one of said second array of dome shaped covers resting on top of an associated one of said second array of spikes and being removable from said associated one of said second array of spikes;

(j) removal means for jettisoning said first array of dome shaped covers and said second array of dome shaped covers from said net after the front tires of said vehicle pass over the lead array of said cross cables exposing the front tires of said vehicle to said second array of spikes and the rear tires of said vehicle to said first array of spikes, said removal means including:

(i) a source for providing compressed air;

(ii) a plurality of fluid passageways, one end of each of said fluid passageways being connected to said source and the opposite end of each of said fluid passageways being connected to an interior of each of said dome shaped covers within said first and second array of dome shaped covers;

(iii) a plurality of normally closed valves, one of said plurality of normally closed valves being positioned within each of said fluid passageways;

(iv) a plurality of sensors, one of said plurality of sensors being mounted on each of said dome shaped covers within said first array of dome shaped cover, said plurality of sensors detecting the presence of the front tires of said vehicle passing over said first array of dome shaped covers and providing electrical signals which indicate that the front tires of said vehicle are passing over said first array of dome shaped covers; and (v) a computer connected to said plurality of sensors, said computer receiving and processing said electrical signals from said plurality of sensors, said computer, responsive to said electrical signals, activating said normally closed valves after the front tires of said vehicle clears said first array of doomed shaped covers, said normally closed valves when activated allowing said compressed air to flow from said source into the interior of each of said dome shaped covers within said first and second array of dome shaped covers causing each of said dome shaped covers within said first and second array of dome shaped covers to be jettisoned from said net; and (l) said second array of spikes being capable of puncturing and adhering to the front tires of said vehicle and said first array of spikes being capable of puncturing and adhering to the rear tires of said vehicle, thereby resulting in the rear end of said net being wrapped around the front tires of said vehicle and the front end of said net being wrapped around the rear tires of said vehicle disabling said vehicle when said vehicle travels across said portable vehicle barrier.

10. The portable vehicle barrier of claim 9 wherein said plurality of elongated cables of said net consist of six elongated cables and said plurality of cross cables of said net consist of twelve cross cables.

11. The portable vehicle barrier of claim 10 wherein the six elongated cables and the twelve cross cables of said net are each fabricated from aramid fibers.

12. The portable vehicle barrier of claim 9 wherein said computer comprises a digital computer.

13. A portable vehicle barrier for disabling a vehicle having front and rear tires traveling across said portable vehicle barrier comprising:

(a) a generally rectangular shaped barrier device comprising a net, said net including a plurality of elongated cables which are evenly spaced apart and a plurality of cross cables which are evenly spaced apart and are perpendicular to the elongated cables of said net;

(b) a lead array of said cross cables including first, second, and third rows of said cross cables located at a front end of said net;

(c) each of the cross cables of the lead array of said cross cables intersecting the elongated cables of said net at a plurality of intersection points;

(e) an array of spikes, one of said array of spikes being connected to each of the plurality of intersection points of the lead array of said cross cables on an upper side of said net;

(f) an array of dome shaped covers, one of said array of dome shaped covers resting on top of an associated one of said first array of spikes and being removable from said associated one of said array of spikes;

(g) a cylindrical shaped member attached to a rear end of said net, said cylindrical shaped member having a length equal to the width of said net;

(h) removal means for jettisoning said array of dome shaped covers from said net after the front tires of said vehicle pass over the lead array of said cross cables exposing the rear tires of said vehicle to said first array of spikes; and (i) said array of spikes being capable of puncturing and adhering to the rear tires of said vehicle, thereby resulting in said net being wrapped around wrapped around the rear tires of said vehicle and said cylindrical shaped member engaging a frame for said vehicle disabling said vehicle when said vehicle completes travel across said portable vehicle barrier.

14. The portable vehicle barrier of claim 13 wherein said plurality of elongated cables of said net consist of six elongated cables and said plurality of cross cables of said net consist of twelve cross cables.

15. The portable vehicle barrier of claim 14 wherein the six elongated cables and the twelve cross cables of said net are each fabricated from aramid fibers.

16. The portable vehicle barrier of claim 13 wherein said removal means comprises:

(a) compression means for providing compressed air;

(b) a plurality of fluid passageways, one end of each of said fluid passageways being connected to said compression means and the opposite end of each of said fluid passageways being connected to an interior of each of said dome shaped covers within said array of dome shaped covers;

(iii) a plurality of valve means, one of said plurality of valve means being positioned within each of said fluid passageways to prevent fluid flow through said fluid passageways;

(d) sensing means mounted on each of said dome shaped covers within array of dome shaped covers, said sensing means detecting the presence of the front tires of said vehicle passing over said array of dome shaped covers and providing electrical signals which indicate that the front tires of said vehicle are passing over said array of dome shaped covers;

(e) signal processing means connected to said sensing means to receive and process said electrical signals from said sensing means;

(f) said signal processing means, responsive to said electrical signals, activating said plurality of valve means after the front tires of said vehicle clears said array of doomed shaped covers; and (g) said plurality of valve means when activated allowing said compressed air to flow from compression means into the interior of each of said dome shaped covers within said first and second array of dome shaped covers causing each of said dome shaped covers within said first and second array of dome shaped covers to be jettisoned from said net.

17. The portable vehicle barrier of claim 16 wherein each of said plurality of valve means comprises a normally closed valve.

18. The portable vehicle barrier of claim 16 wherein said sensing means comprises a plurality of sensors, one of said plurality of sensors being mounted on each of said dome shaped covers within said array of dome shaped cover, said plurality of sensors being connected to said signal processing means.

19. The portable vehicle barrier of claim 16 wherein said signal processing means comprises a computer.

20. The portable vehicle barrier of claim 16 wherein said signal processing means comprises a digital computer.

* * * * *